US005221184A

United States Patent [19]

Gesenhues et al.

[11] Patent Number: 5,221,184

[45] Date of Patent: Jun. 22, 1993

[54] BEARING JOURNAL FOR THE PLASTIC IMPELLER OF A COOLANT PUMP

[75] Inventors: Bernhard Gesenhues, Birkenau; Detlef Cordts, Ober-Mumbach, both of Fed. Rep. of Germany

[73] Assignee: Firma Carl Freudenberg, Weinheim/Bergstr., Fed. Rep. of Germany

[21] Appl. No.: 760,110

[22] Filed: Sep. 16, 1991

[30] Foreign Application Priority Data

Sep. 17, 1990 [DE] Fed. Rep. of Germany ..... 4029435

[51] Int. Cl.[5] ..... F01D 25/00

[52] U.S. Cl. ..... 415/216.1; 415/200

[58] Field of Search ..... 415/200, 216.1

[56] References Cited

U.S. PATENT DOCUMENTS

| | | | |
|---|---|---|---|
| 3,304,875 | 2/1967 | Copeland | 415/200 |
| 3,367,274 | 2/1968 | Lombard | 415/216.1 |
| 3,494,292 | 2/1970 | Walker | 415/200 |
| 3,664,760 | 5/1970 | Reiner | 415/200 |
| 3,926,281 | 12/1975 | Hannibal | 417/492 |
| 4,784,574 | 11/1988 | Tsuno et al. | 415/216.1 |

FOREIGN PATENT DOCUMENTS

| | | | |
|---|---|---|---|
| 001855E | 6/1946 | United Kingdom | 415/200 |

*Primary Examiner*—Edward K. Look
*Assistant Examiner*—Mark Sgantzos
*Attorney, Agent, or Firm*—Kenyon & Kenyon

[57] ABSTRACT

The plastic impeller of a coolant pump is attached to the bearing shaft with a bearing journal, so that the journal engages to be seated firmly in an axial bore of the shaft. Here, the bearing journal and the impeller are formed in one piece of the same material. The bearing journal is pressed or glued into the bore of the bearing shaft, and the impeller as well as the bearing journal are formed of a phenolic resin which is resistant to the coolant.

6 Claims, 1 Drawing Sheet

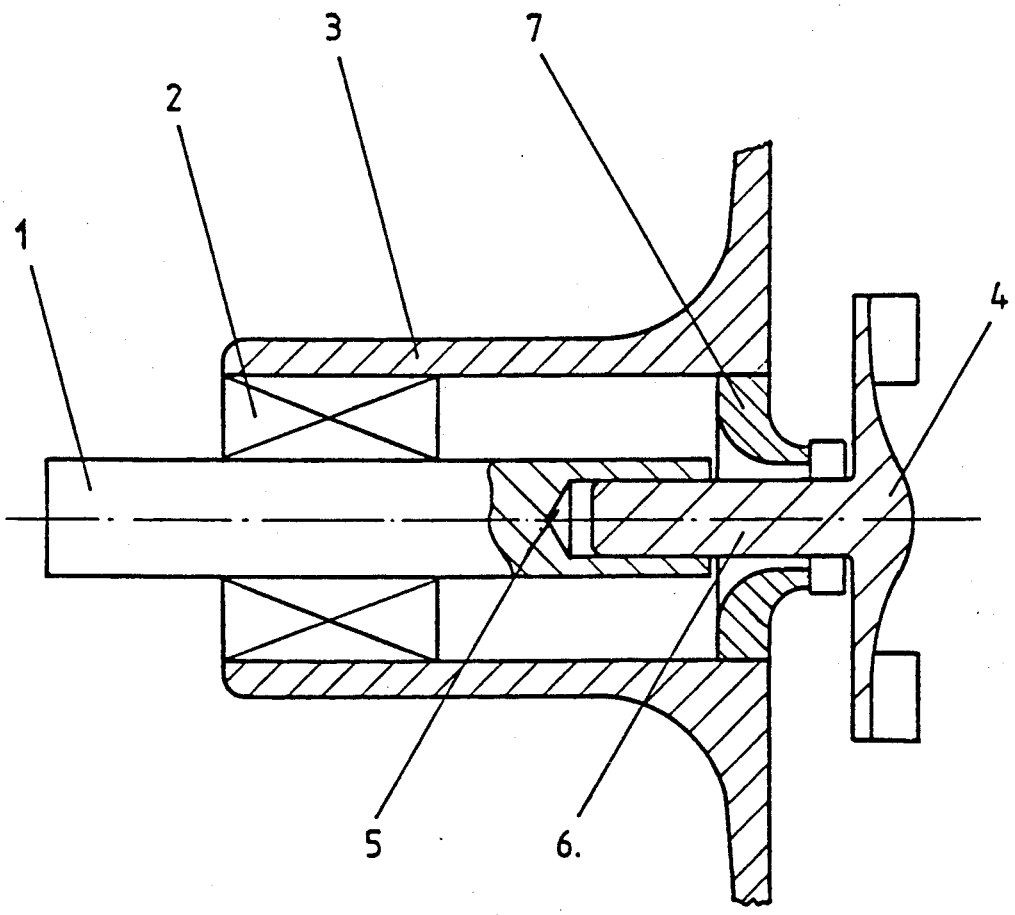
3
7
2
1
4
5
6.

BEARING JOURNAL FOR THE PLASTIC IMPELLER OF A COOLANT PUMP

BACKGROUND OF THE INVENTION

The present invention relates generally to impeller attachment and more particularly to the attachment of the impeller of plastic material of a coolant pump to the bearing shaft in such a way that the impeller can not rotate with respect to the bearing shaft.

In known attachments, the impeller is attached to the bearing shaft by being pressed onto the shaft, either directly or with a molded insert. This structural scheme presents several problems. For example, almost all plastics tend to swell in coolants. This has resulted in a loosening of the connection between the impeller and the bearing shaft in the previously known designs where plastics have been used, although the changes in dimensions have been in the per thousand range. The loss of strength of the press fit between the impeller and the shaft is caused not only by the swelling of the plastic, but also by the heating of the coolant (and with it of the entire system), since the materials of the bearing shaft and of the impeller have different coefficients of thermal expansion.

The invention is directed to further improving the connection between an impeller made of plastic and the bearing shaft of a coolant pump, especially of the type used in internal combustion engines.

SUMMARY OF THE INVENTION

The invention provides for several improvements in the connection between the impeller and bearing shaft.

The diameter of the axial face seal which seals the bearing journal off from the pump housing can be kept smaller than usual, i.e. below 12 to 16 mm, which improves the sealing effect. The design is also less sensitive to angle and positional changes of the bearing shaft and the axial face seal. Furthermore, loosening of the fit of the pressed-on plastic impeller does not take place when the coolant is heated. Also, swelling of the plastic in the coolant does not result in the loosening of the fit of the impeller on the shaft.

This improvement is obtained by the use of a bearing journal attached to the impeller, which is seated in an axial bore of the bearing shaft having an appropriately corresponding diameter. The bearing journal connects the impeller with the bearing shaft so as not to allow rotation between these parts. The bearing journal is pressed or glued into the bore of the bearing shaft. The bearing journal and the impeller are formed as one piece and of the same material, generally a phenolic resin which is resistant to the coolant.

By making the bearing journal and the impeller of phenolic resin, a common plastic which swells only slightly in the coolant (generally a water/glycol mixture), one obtains a strong fit of the journal in the axial bore of the shaft at all times during operation of the pump, even in case of shocks and in the face of coolant heating.

Experience has shown the coolant may be heated to as much as 130° C. for coolant pumps. This level of heating can cause the plastic impeller to swell. Where the impeller is fitted onto the bearing shaft, this can cause a loosening of the joint between shaft and impeller. However, in the present invention, the swelling of the plastic material of the impeller, which was undesirable until now, is utilized by the invention in order to further strengthen the fit. This is due to the effect provided by the different expansion rates of the materials of the impeller and bearing journal on the one hand (which is fitted into the bearing shaft), and the bearing shaft on the other as the temperature increases.

The one-piece production of the impeller and the journal using phenolic resin plastics is accomplished according to known techniques; for example, by pressing or injection molding.

One may facilitate assembly (pressing or gluing the bearing journal into the axial bore of the bearing shaft) by providing that the bearing journal narrow conically at its end facing away from the impeller.

Gluing may be accomplished with known adhesives which permanently join the bearing shaft, which is made of steel, and the bearing journal, which is made of plastic. These adhesives must, of course, be inert with regard to the coolant and the pump temperatures. Examples of such adhesives are: phenol-polyvinyl, phenol-epoxy, phenolnitrile systems, neoprene and methacrylate.

BRIEF DESCRIPTION OF THE DRAWING

The figure provides a cross-sectional view of a bearing shaft in the bearing of a pump housing constructed according to the principles of the invention.

DETAILED DESCRIPTION

The figure shows a bearing shaft 1 in the bearing 2 of a pump housing 3. The axial bore 5 of the bearing shaft 1, which is open in the direction of the impeller 4, is filled by a bearing journal 6, which carries the impeller 4 molded unitary with the bearing journal. Part 6 and part 4 are made of phenolic resin.

The axial face seal 7 seals the bore 5 from the coolant-containing outside environment of the pump.

As can be seen in the figure, the joint does not lie in the coolant, and therefore the coolant is advantageously less able to attack the adhesive. Furthermore, the lifespan of the bearing is increased in this manner, since the transfer of heat from the coolant into this bearing is reduced to a very great extent.

Of course, the method of installation of the axial face seal as shown is not the only possible one; a counterring could be mounted on the bearing shaft, without thereby departing from the of the invention.

What is claimed is:

1. A bearing journal for the plastic impeller wheel of a coolant pump, comprising:

a bearing journal and a plastic impeller formed as one part and made from coolant resistant phenolic resin; and a bearing shaft having an axial bore for accommodating the bearing journal so as allow the bearing journal to connect the impeller with the bearing shaft so that the bearing shaft does not rotate with respect to the bearing journal or impeller, wherein the bearing shaft is made of a material having a different coefficient of thermal expansion than the bearing journal so that in the event that the device is heated, the bearing journal will expand at a rate greater than the rate of expansion of the axial bore of the bearing shaft, thereby tightening the fit between the bearing journal and the bearing shaft.

2. The device of claim 1, wherein the connection between the bearing shaft and the bearing journal is formed with adhesive.

3. The device of claim 1, wherein the connection between the bearing shaft and the bearing journal is formed through a press fit of the bearing journal into the bearing shaft.

4. A bearing journal for the plastic impeller wheel of a coolant pump, comprising:

a bearing journal and a plastic impeller formed as one part and made from coolant resistant phenolic resin material;

a bearing shaft having an axial bore for accommodating the bearing journal so as to allow the bearing journal to connect the impeller with the bearing shaft so that the bearing shaft does not rotate with respect to the bearing journal or impeller; and a pump housing, a bearing within the pump housing, and an axial face seal so that the bearing shaft and bearing journal are axially supported within the pump housing by the bearing and the axial face seal, wherein the face seal serves to isolate the junction of the bearing journal and the axial bore from the coolant.

5. The device of claim 1, wherein the bearing shaft is made of metal.

6. The device of claim 1, wherein the bearing shaft is made of steel.

* * * * *